United States Patent [19]

Lewis

[11] Patent Number: 4,693,203

[45] Date of Patent: Sep. 15, 1987

[54] SEGMENTED BOAT

[76] Inventor: Marvin C. Lewis, P.O. Box 225, Murrels Inlet, S.C. 29576

[21] Appl. No.: 693,590

[22] Filed: Jan. 22, 1985

[51] Int. Cl.[4] ..... B63B 7/02

[52] U.S. Cl. ..... 114/353; 114/357

[58] Field of Search ..... 114/363, 353, 357, 352; 248/641; 224/42.01, 42.03 R; 190/1

[56] References Cited

U.S. PATENT DOCUMENTS

| | | | |
|---|---|---|---|
| 1,445,792 | 2/1923 | Olson | 114/343 |
| 2,422,930 | 6/1947 | Rutledge | 114/353 |
| 2,808,218 | 10/1957 | Steller | 248/641 |
| 3,097,371 | 7/1963 | Rough | 114/353 |
| 3,588,787 | 4/1970 | Strong et al. | 296/100 |
| 3,594,834 | 7/1971 | Steensen | 114/353 |
| 3,684,139 | 8/1972 | Johnson | 224/42.01 |
| 3,958,289 | 5/1976 | Carlson | 114/363 |
| 4,236,474 | 12/1980 | Buirski et al. | 114/56 |
| 4,474,131 | 10/1984 | Buirski et al. | 114/343 |

FOREIGN PATENT DOCUMENTS

| | | | |
|---|---|---|---|
| 1591580 | 6/1981 | United Kingdom | 114/357 |

*Primary Examiner*—Joseph F. Peters, Jr.
*Assistant Examiner*—Edwin L. Swinehart
*Attorney, Agent, or Firm*—William R. Hinds

[57] ABSTRACT

Portable boat which includes a pair of shells which may be connected end to end to form a boat, and which can be connected one atop the other to form a storage box, each shell being of double walled construction, and including a transom for connection of a propelling motor when the apparatus is used as a boat. The apparatus includes seat members which may be connected to form a storage compartment.

12 Claims, 8 Drawing Figures

Fig. 3
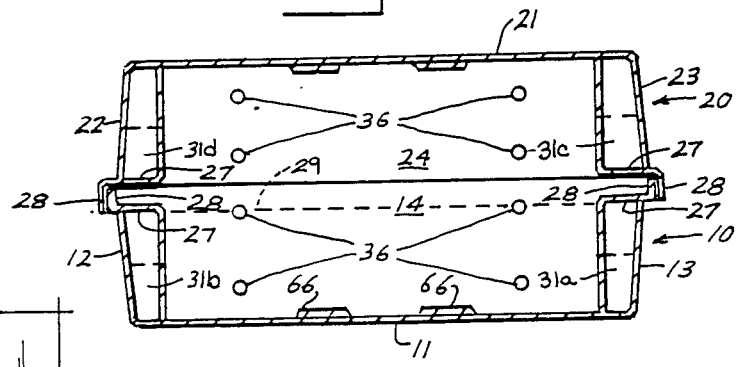
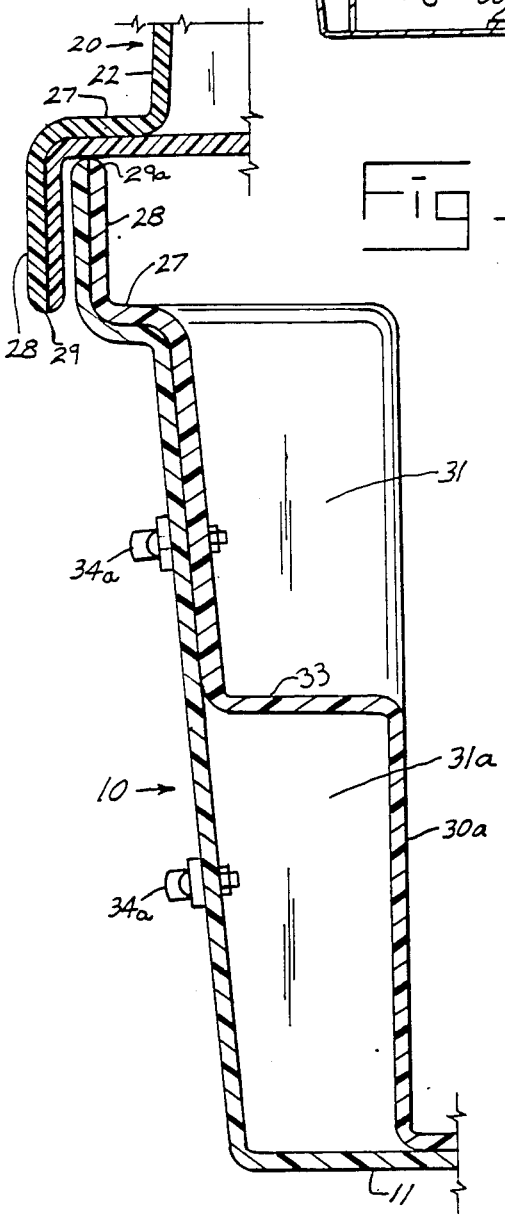
Fig. 4
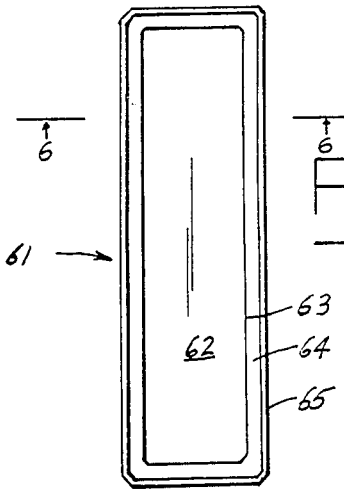
Fig. 5
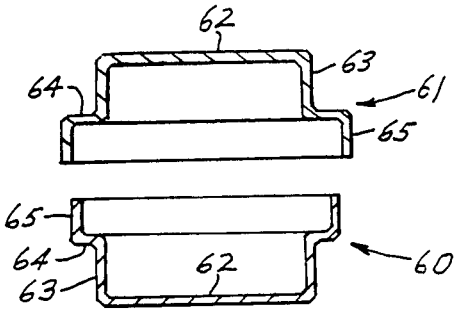
Fig. 6

SEGMENTED BOAT

BACKGROUND OF THE DISCLOSURE

It is likely that a number of boat structures have been devised, for boats which will fold or which can be taken apart, so that the boat can be stored in a smaller space, or more easily carried and transported. Insofar as is known, no completely satisfactory boat of this nature has been provided in the art. This invention seeks to provide an improved boat structure which will be more satisfactory than previously known boat structures, and which is convenient and light in weight, yet suitable for its intended purpose.

SUMMARY OF THE INVENTION

The invention provides a boat structure having two half parts in the form of shells, which are connected together to form a complete boat. The shells may be engaged together to form a box-like assembly, in which condition the boat may be transported, and which may alternatively be used as a storage box, or the like. One of the shells may be used alone as a smaller boat. The shells are formed to have internal sealed air spaces, to be unsinkable. The shells are formed of molded fibreglass, and are lightweight, strong and of pleasing appearance. The assembled boat may be driven over the water by a low-horsepower motor, either gasoline or battery powered, and have a reinforced transom area and transom fitting by which a motor may be readily connected.

A principal object of the invention is to provide a sectional boat structure. Another object is to provide such a boat structure in which two shells are connected together end-to-end to form a boat twice the length of each shell. Another object is to provide such a boat structure having sealed buoyancy chambers rendering the boat virtually inpossible to sink. Yet another object of the invention is to provide such a boat structure which may also be used as a storage box. Another object is to provide such a boat structure which is light in weight, is strong and is economical, yet is durable in use.

Other objects and advantages of the apparatus according to the invention will appear from the following description of a preferred embodiment, reference being made to the accompanying drawings.

BRIEF DESCRIPTIONS OF THE DRAWINGS

FIG. 3 is a vertical cross section taken at line 3—3 of FIG. 1.

FIG. 4 is an enlarged vertical cross section taken at line 4—4 of FIG. 2.

FIG. 5 is a plan view of a seat element used with the invention, shown inverted.

FIG. 6 is an enlarged vertical exploded cross section taken at line 6—6 of FIG. 5, and showing an additional seat element.

DESCRIPTION OF THE PREFERRED EMBODIMENT

Figure 1:
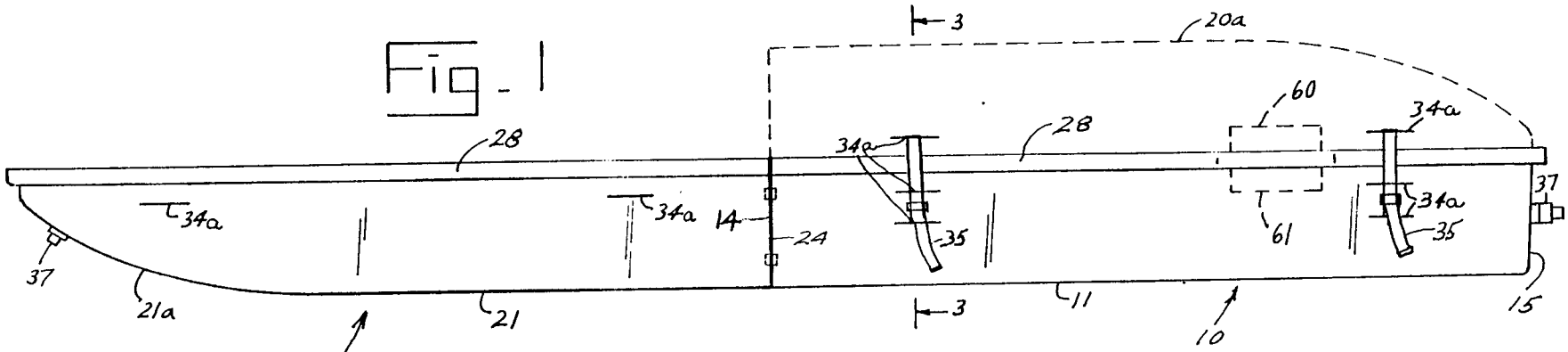
FIG. 1 is a side elevation of a preferred embodiment of apparatus according to the invention, showing one element of the apparatus in dashed lines in a moved position.
Figure 2:
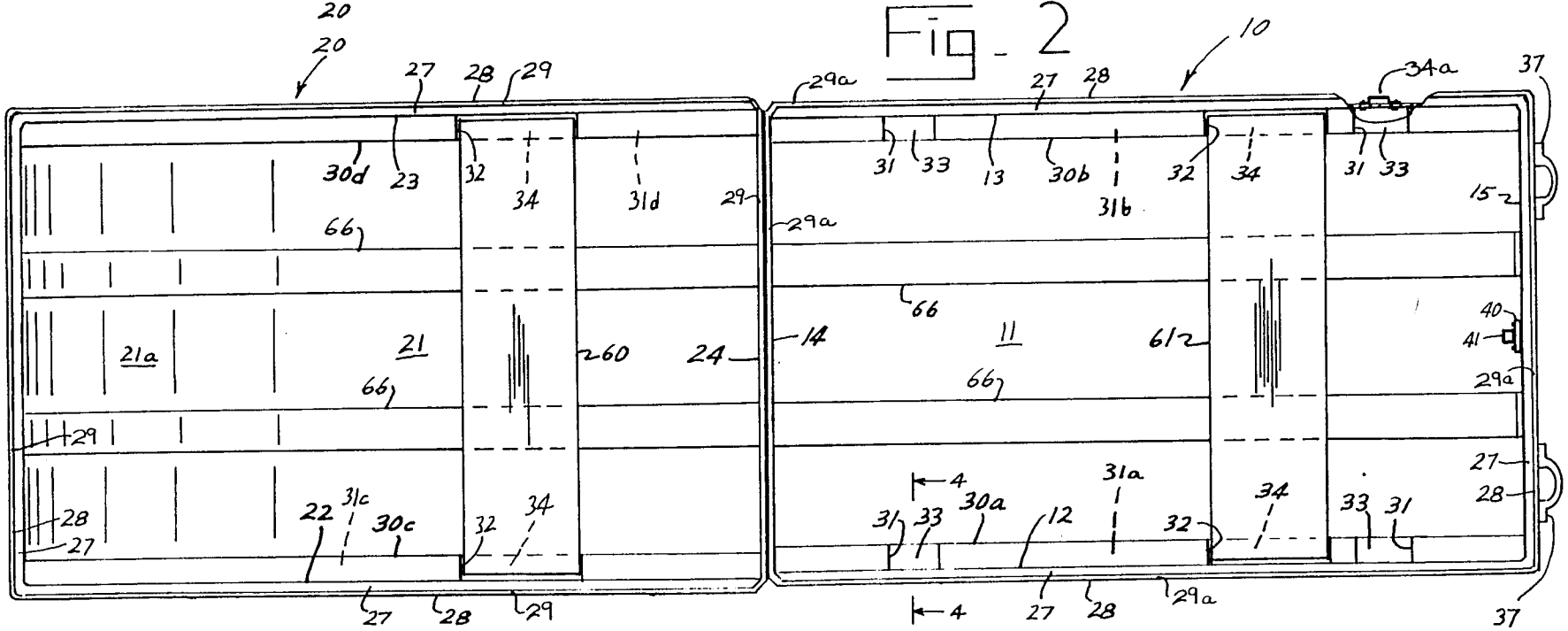
FIG. 2 is a plan view of the apparatus of FIG. 1.

Referring now to the drawings in detail, and first to FIGS. 1–2, a first shell element 10 has bottom 11, sides 12, 13, and ends 14, 15, being open at its top. A second shell element 20 has bottom 21, curved upwardly at its lefthand portion 21*a*, as shown best in FIG. 1, sides 22, 23, and end 24, upwardly curved bottom portion 21*a* serving as the end opposite end 24. At the upper end of each of sides 12, 13, 22, 23, and ends 15, 21*a*, there is provided an outwardly extending narrow flange 27 terminating in an upstanding flange 28. The terminal edges of the upstanding flange 28, of shell element 10, and the terminal edge of end 14 form a rim 29*a* extending around the uppermost edge of shell element 10. Likewise, the terminal edges of the upstanding flange 28, of shell element 20, and the terminal edge of end 24 form a rim 29 extending around the uppermost edge of shell element 20. As is shown in FIGS. 2, 3 and 4, rim 29*a* is slightly inward of rim 29 so that when shell element 20 is inverted and placed atop shell element 10, as indicated by dashed line 20*a* in FIG. 1, the rim 29 of shell element 20 will overlap the rim 29*a* of shell element 10 outwardly. Thus, when shell element 20 is placed on top of shell element 10 as described, the two shell elements form a box adapted to shed falling water such as rain or snow, and contents placed within the shells will be protected to remain dry.

Each shell element 10, 20 has along its respective sides 12, 13 and 22, 23, inwardly spaced walls 30*a*–*d*. Referring now also to FIGS. 3–4 of the drawings, the sides 12, 13 and walls 30*a*, 30*b* form air spaces 31*a*–*d* which are sealed around their edges so that they form buoyancy chambers to prevent the shell elements from sinking in water. The spaces 31*a*–*d* may preferably be filled with a foam material the air spaces of which are sealed, so that should a water leak into a space 31*a*–*d* occur, the buoyancies of the shell elements will be retained.

The walls 30*a* and 30*b* are deformed at 31 and 32, to form shoulders 33 and 34. At each deformation 31, a strap bracket 34*a* is bolted to shell 10, as best shown in FIG. 4. Brackets 34*a* are also affixed to shell 20, at corresponding locations thereof. These brackets are used to connect shell elements 10, 20 together, as at the righthand portion of FIG. 1, the brackets 34*a* being shown schematically in FIG. 1, and the connecting straps are indicated by reference numerals 35.

Shell elements 10, 20 are connected together by plural bolts, four such being indicated at 36 in FIG. 3. the elements 36 are, of course, bolt holes, which are aligned when end 14, 24 are placed together. Bolts are run through the aligned bolt holes and secured by nuts screwed thereon, it being preferred that resilient sealing washers be disposed against the undersides of the bolt heads and the corresponding sides of the nuts, to provide seals around the bolt holes. The washers may be bonded to the bolt heads and nuts so as to not be subject to being lost.

Handles 37, similar in form to gate handles, are provided at the end of each shell element to facilitate handling thereof.

Figure 7:
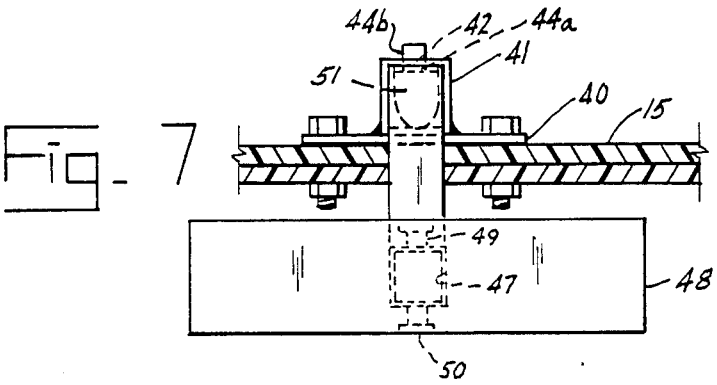
FIG. 7 is a partial top elevation showing the transom structure of the apparatus.
Figure 8:
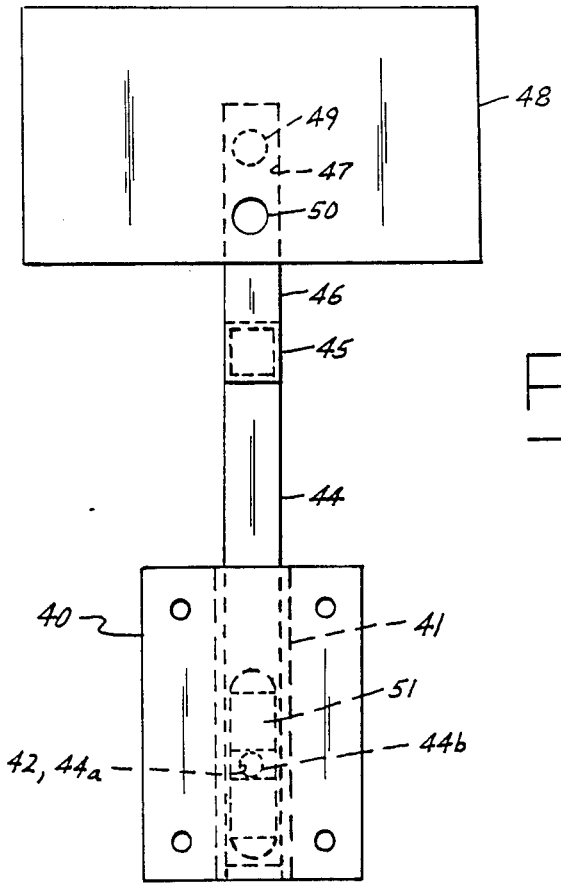
FIG. 8 is a side elevation showing the transom elements.

At the transverse center of end 15 of shell element 10, a plate 40 is affixed in place by bolts and nuts, as best shown in FIG. 7 of the drawings. Plate 40 is flat and has a length of square tubing 41 welded thereto in vertical disposition. Tubing 41 has a circular hole 42 through its wall facing the interior of the boat structure. Square tubing 44 of a size to telescope within tubing 41 is connected at its upper end to another section of square tubing 45 disposed horizontally over the rear wall 15 of the boat structure, tubing 45 in turn being connected to a vertical length of square tubing 46. Tubing 46 is received into an opening 47 of square cross section extending into the bottom of a plate 48, plate 48 being secured to tubing 46 by screws 49, 50, as shown.

Tubing 44, near its lower end within tubing 41, has a circular opening 44*a* through which a pin 44*b* is slidably disposed. Pin 44*b* is carried by a shaped plate spring 51 which resiliently bears against tubing 44 at its part adjacent pin 44*b*, and the ends of which are angled back to be resiliently bearing against the opposite wall of tubing 44, to that pin 44*b* is resiliently biased into opening 44*a* and also into opening 42 of tubing 41, this securing tubing 44 against longitudinal movement within tubing 41. When pin 44*b* is resiliently depressed out of opening 42, tubing 44 may be slid longitudinally within tubing 41 to be removed therefrom. Therefore, tubing 44 may be slid into tubing 41 when pin 44*b* is depressed and latched in place when pin 44*b* enters opening 42, and may be released and removed as described.

Plate 48 serves as a mounting plate for connection of a small outboard motor or trolling motor to the rear wall or transom of the boat and is formed to have surfaces at both its back and front in order that an outboard motor, battery or gasoline powered, may be secured thereto by the customary clamps.

In FIGS. 5 and 6 there is shown the structures of a pair of seats for the boat structure. Each molded fibreglass seat 60, 61 has a central plate portion 62, and a surrounding sidewall 63, an outturned flange 64, and a vertical flange or rim 65. The rim of seat element 60 is adapted to fit within the rim of seat element 61, so that the two elements may be engaged to form a storage box. The seat elements are preferably so engaged when the shell elements are engaged as shown at the righthand side of FIG. 1, to provide a container for the transom element. Other equipment may also be stored in this box.

For use as seats, the elements 60, 61 are turned so that the central plate portions face upwardly, and are engaged in the recessed formations 32, 32 shown in FIG. 2 of the drawings, being similarly disposed when the seat elements are engaged to form a box, as indicated at the righthand portion of FIG. 1 by dashed lines.

The engaged shell portions may be used as a cartop storage box, or may be carried on a small trailer as a storage box. The apparatus is small enough that it may be readily transported in a pickup truck, in a station wagon, or even in the trunk of a large automobile. After the user has arrived at a point of use of the boat, the shell elements and transom elements may be quickly and easily assembled, to provide a boat of sufficient utility for use on any body of water which is sufficiently quiet and free of turbulence. As made, the assembled boat may be 10 feet or longer in length, may have a beam of anywhere between three and four feet, and a draft of from 12 to 16 inches. The boat may be powered by a motor of up to 2 horsepower, and is approved for such use.

Of course, boats larger than described may be made according to the concepts of the invention.

The hull shells may be used as open or closed containers, and a single shell may be used alone as a smaller boat. Since the hull shells have built-in flotation chambers, use of the boat is quite safe. The shapes of the hull shells makes them not prone to tipping over. The double walled construction gives the boat a great deal of strength, yet the boat is light enough in weight that it may be assembled and launched by a single person.

It will be realized that the inner and outer walls of the shell structures are bonded together at all contact points to provide a unitary strong and safe hull construction. Ribs 66 strengthen and stiffen the hulls 10, 20.

The seat elements may be provided with folding legs so that they may be used as benches on land or other surfaces.

While a preferred embodiment of the apparatus has been described and shown in the drawings, many modifications thereof may be made by a person skilled in the art without departing from the spirit of the invention, and it is intended to protect by Letters Patent all forms of the invention falling within the scope of the following claims.

I claim:

1. A segmented boat comprising a pair of opentopped shells; each said shell having a pair of sides and a pair of ends, each of said sides and one of said ends including an outwardly extending flange terminating in an upstanding flange; each of said shells having a rim therearound along its uppermost edge, each said rim being comprised of a terminal edge of each said upstanding flange along said sides and said one of said ends and a terminal edge of the remaining end, said upstanding flange and rim of one shell being capable of being disposed outwardly of and telescopically overlapping with the upstanding flange and rim of the other said shell when placed together with one shell inverted relative the other shell for forming an enclosed box, and means for releasably connecting said shells together in said enclosed condition.

2. The boat of claim 1, each said shell including a portion having double walls, and flotation chambers formed between said walls.

3. The boat of claim 2, including means for connecting said shells together end to end to provide a boat equal in size to the sum of the sizes of said shells.

4. The boat of claim 3, each said shell being of generally rectangular horizontal cross sections, said upstanding flange extending around only said pair of said sides and said one of said ends of each said shell and each shell having a flangeless end, said shells being connected as described in claim 3 at said flangeless ends.

5. The boat of claim 4, each said shell including projecting interior reinforcing rib means formed in the inner of said double walls.

6. The boat of claim 5, said reinforcing rib means extending across the end of each said shell which is opposite its said flangeless end.

7. The boat of claim 6, including bracket means fixed to an end of one of said shells opposite said flangeless end thereof, said bracket means being capable of connection to a removable transom means.

8. The boat of claim 7, said transom means including connection means for releasable connection with said bracket means, upstanding shaft means extending from said connection means, and a transom plate carried at the upper end of said shaft means to which a boat propelling motor may be releasably clamped.

9. The boat of claim 8, said transom plate being offset outside the perimeter of said shell whereby a motor connected thereto will have ample clearance from said shell.

10. The boat of claim 2, said double walls including inner walls and outer walls, said inner of said double walls each having outwardly upset portions forming upwardly facing shoulders, and a pair of seat members disposed to rest upon opposite ones of said shoulders.

11. The boat of claim 10, each said seat member comprising an open topped shallow box having a rim around its upper edges, said rims of said seat members being telescopically interfitting, where the pair of seat members may be placed together to form a storage box, said interfitting seat members being received across a pair of opposite shoulders for use as storage space when said shells form said enclosed box.

12. The boat of claim 11, said shells and said seat members being formed of fibreglass.

* * * * *